US005743787A

United States Patent [19]

Ishiyama et al.

[11] Patent Number: 5,743,787

[45] Date of Patent: Apr. 28, 1998

[54] METHOD FOR POLISHING OPTICAL FIBER END SURFACE

[75] Inventors: Keiichi Ishiyama; Kohji Minami; Hiroyuki Tokita; Toyokazu Iwakiri; Nobuo Suzuki, all of Chiba, Japan

[73] Assignee: Seiko Instruments Inc., Japan

[21] Appl. No.: 541,208

[22] Filed: Oct. 12, 1995

[30] Foreign Application Priority Data

Oct. 13, 1994 [JP] Japan ..... 6-248103

[51] Int. Cl.[6] ..... B24B 1/00

[52] U.S. Cl. ..... 451/41; 451/57; 451/59; 451/278

[58] Field of Search ..... 451/41, 57, 278, 451/42, 279, 59

[56] References Cited

U.S. PATENT DOCUMENTS

| | | | |
|---|---|---|---|
| 4,839,993 | 6/1989 | Masuko et al. . | |
| 4,999,955 | 3/1991 | Saito et al. | 451/41 |
| 5,007,209 | 4/1991 | Saito et al. | 451/41 |
| 5,184,433 | 2/1993 | Maack | 451/41 |
| 5,216,846 | 6/1993 | Takahashi | 451/57 |
| 5,349,784 | 9/1994 | Grois et al. | 451/314 |
| 5,351,327 | 9/1994 | Lurie et al. | 385/78 |
| 5,351,445 | 10/1994 | Takahashi | 451/271 |
| 5,503,590 | 4/1996 | Saitoh et al. | 451/57 X |

FOREIGN PATENT DOCUMENTS

| | | |
|---|---|---|
| 657247 | 6/1995 | European Pat. Off. . |
| 662366 | 7/1995 | European Pat. Off. . |
| 8804217 | 6/1988 | WIPO . |

*Primary Examiner*—Timothy V. Eley
*Attorney, Agent, or Firm*—Adams & Wilks

[57] ABSTRACT

A method of polishing an end surface of an optical fiber comprises tilting the central axis of a ferrule integrated with an optical fiber at a preselected angle Θ to the axis of rotation of a flat polishing member. A foremost end of the ferrule is then moved into contact with a flat polishing member to polish the foremost end of the ferrule and an end surface of the optical fiber. The foremost end of the ferrule is moved out of contact with the flat polishing member after the ferrule and the optical fiber have been polished into a flat plane. The central axis of the ferrule is then tilted at the angle Θ to the axis of rotation of a platen and at an angle θ=Θ+Δ to a line normal to the surface of the platen, where Δ is an angle of tilt of the rotational platen relative to a flat support surface supporting the rotational platen. Thereafter, the foremost end of the ferrule is moved into contact with a second polishing machine to polish the ferrule and the optical fiber. The ferrule is moved out of contact with the polishing member after the ferrule and the optical fiber have been polished into an oblique convex spherical surface so that an oblique angle defined between a plane normal to the central axis of the ferrule and a tangent plane at the intersection of the central axis of the ferrule and the surface is equal to angle Θ.

6 Claims, 2 Drawing Sheets

METHOD FOR POLISHING OPTICAL FIBER END SURFACE

BACKGROUND OF THE INVENTION

The present invention relates to an optical fiber end surface-polishing machine for polishing an end surface of an optical fiber used in optical fiber communications into an oblique convex spherical surface.

Optical connectors used in optical fiber communications are required to have small insertion loss and produce less reflected, returning light. Various proposals have been heretofore made to satisfy these requirements simultaneously. The most predominant optical connector which meet these requirements best at this time is an optical connector having a ferrule end surface which has been polished together with an end surface of an optical fiber into a convex spherical surface at an angle to a plane that is vertical to the axis of the optical fiber. This connector is normally known as an "oblique PC connector". This oblique angle is so determined that it makes a certain normalized angle Θ to the plane vertical to the axis of the optical fiber. In order to reduce the insertion loss and to reduce the reflected, returning light, the optimum angle of the normalized angle is selected, for example, to be 8 degrees, 10 degrees, or 12 degrees, depending on the kind of the optical fiber. In the oblique PC connector, this normalized angle Θ is the angle Θ made between the tangent plane at the intersection of the axis of the optical fiber and the convex spherical surface and the plane vertical to the optical fiber, as shown in FIG. 2.

The end surface of this connector has been heretofore formed in the manner described below. The prior art method is illustrated in FIGS. 3A–3B. As shown in FIG. 3A, a ferrule to be polished is pressed against the grinding wheel disk whose surface is flat in such a way that the ferrule is tilted at a given angle of θ, thus performing oblique polishing. Then, as shown in FIG. 3B, the ferrule is pressed against a grinder while maintaining the angle θ, to polish the ferrule. The grinder comprises a flat platen on which a resilient body 4 and polishing sheet 5 are placed. At this time, the resilient body 4 warps into a spherical form and so the end surface of the ferrule is polished into an oblique convex spherical surface.

In order to make full use of the performance of the oblique PC connector, i.e., low loss and low reflection, it is important that the angle of tilt of the spherical surface formed by the polishing, i.e., the angle Θ' made between a contact plane at the intersection of the axis of an optical fiber and the convex spherical surface and a plane vertical to the axis of the optical fiber (i.e., the angle between the normal at the central point of the optical fiber and the axis of the ferrule), be equal to the normalized angle Θ. This means that the vertex of the convex spherical surface agrees with the axis of the ferrule (i.e., the center of the optical fiber) at the normalized angle.

The ferrule is normally chamfered. That is, a thinned outer peripheral portion is formed at the front end so that the ferrule is easily inserted into a cylindrical sleeve when the optical fiber is placed in opposition to the ferrule and connected via the sleeve. When the chamfered ferrule is polished by the aforementioned method while tilted at the normalized angle Θ (θ=Θ), the ferrule is not polished into a convex spherical surface at the normalized angle Θ, for the following reason.

In the polishing method described above, the polishing removal progresses coaxially from the outermost portion of the end surface of the ferrule pressed against the polishing sheet on the resilient body. As a result, at the end of the polishing, as shown in FIG. 3B, the vertex of the convex spherical surface shifts into the middle point P between two points A and B lying on the chamfered portion. Consequently, the vertex deviates from the center F of the optical fiber. The amount of deviation d is found in the manner described below.

In FIGS. 3A–3B, r indicates the radius (normally, 1.25 mm) of the ferrule, α indicates the angle of chamfer of the front end portion of the ferrule, L indicates the length of the chamfer, θ indicates the angle made between the axis of the ferrule and the normal to a polishing platen, R is the radius of curvature of the ferrule end surface polished into a convex spherical surface, a point F on the convex spherical surface indicates a point located on the axis of the optical fiber, Θ' indicates the angle made between the normal at the point F on the spherical surface formed by the polishing and the axis of the ferrule, and d indicates the straight distance between points P and F.

It can be seen that by geometrical calculations, d and Θ' can be represented by $$d \approx (L^*\tan\alpha - 1)(\tan\alpha^*\tan\theta)/(\tan\alpha^*\tan\theta - 1) \quad (1)$$

$$\Theta' = \tan^{-1}\{(R^*\sin\theta - d)/[R^2 - (R^*\sin\theta - d)^2]^{1/2}\} \quad (2)$$

Normal dimensions of the ferrule, i.e., α=30 degrees and L=0.5 mm, are substituted into the formulas. Also, we assume that θ=Θ=8 degrees. Then, the amount of deviation d between the optical fiber axis and the convex spherical surface vertex is about 90 μm. By substituting R=20 mm into the formula, we have Θ'≈7.75 degrees. This R is determined by the hardness of the resilient body under the polishing sheet and by the polishing conditions including the force applied to the ferrule. The R is empirically found. Accordingly, where optical connectors having ferrules polished as described above are brought into abutment with each other from opposite sides, the optical fiber end surface touches at the point F but the angle made between the normal to the spherical surface at the point F and the optical axis is 7.75 degrees. It substantially follows that the ferrule is polished obliquely at 7.75 degrees. Therefore, with θ=8 degrees, the ferrule cannot be polished at the normalized angle Θ=8 degrees for the oblique convex spherical surface polishing.

This problem is alleviated by eliminating (α=0) the chamfered portion of the outer peripheral portion at the front end of the ferrule. However, it is impossible to set the oblique polishing angle exactly to 8 degrees. Furthermore, when the ferrule is inserted into the cylindrical sleeve, placed in an opposite relation, and connected to it, the chamfered portion is imperative because of easiness of the insertion, prevention of generation of dust, and for other reasons.

It is an object of the present invention to obtain a desired normalized oblique polishing angle Θ when a ferrule having a normal shape and having a chamfered portion in the outer peripheral portion at the front end is polished into an oblique convex spherical surface.

SUMMARY OF THE INVENTION

In an attempt to solve the foregoing problem, we have taken notice of the aforementioned characteristics of the machining of the convex spherical surface, using the resilient body. The invention is characterized in that when the convex spherical surface is machined, the angle θ between the ferrule and the polishing platen is equal to the normalized angle Θ+ a minute angle Δ in order to achieve Θ' (angle obtained by polishing)=Θ (normalized angle).

The object can be achieved by entering the conditions used in the formulas (1) and (2) such as those about the ferrule and obtaining such a polishing angle θ that Θ'=Θ.

For example, where the ferrule just satisfying the above-described conditions is used, Θ'=8 degrees can be obtained by setting angle θ to 8.25 degrees.

It is to be noted that this angle correction is necessary only when the convex spherical surface is machined. The correction is not needed when an oblique plane is machined prior to machining of the convex spherical surface.

DETAILED DESCRIPTION OF THE PREFERRED EMBODIMENT

Figure 1:
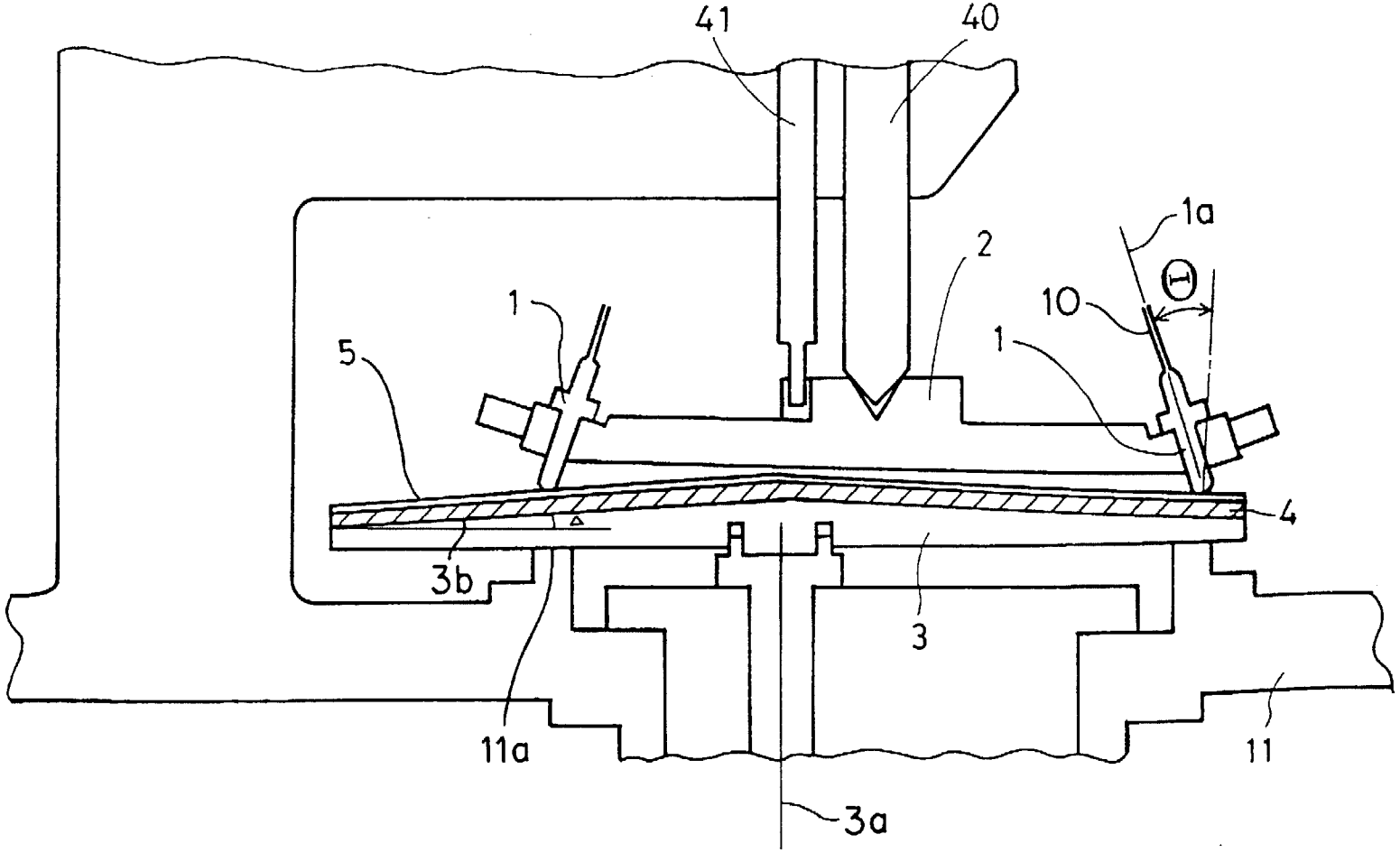
FIG. 1 is a cross section showing an optical fiber end surface-polishing machine according to the present invention.
Figure 2:
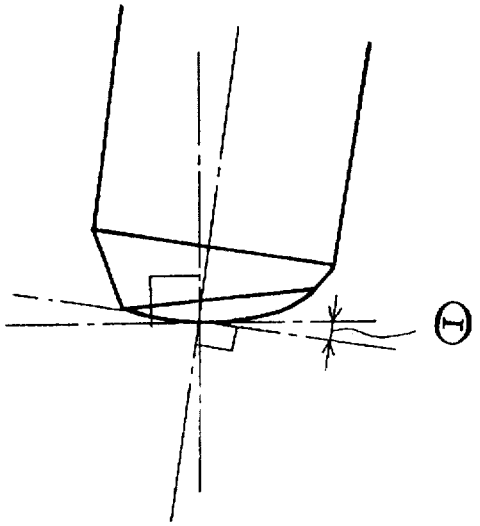
FIG. 2 is a side elevation of a ferrule end portion, illustrating normalized angle Θ of oblique convex spherical surface polishing.
Figure 3A:
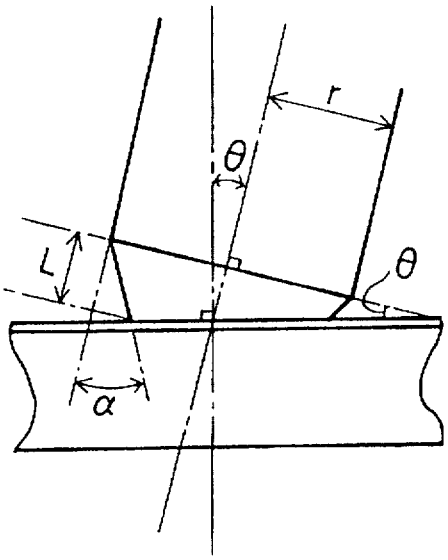
FIG. 3A PRIOR ART
FIGS. 3A and 3B are side elevations of a ferrule end surface, illustrating the prior art oblique convex spherical surface polishing method.
Figure 3B:
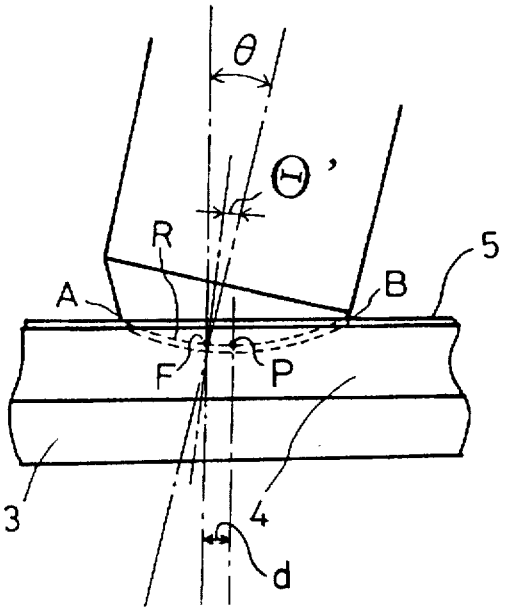
FIG. 3B PRIOR ART

FIG. 1 shows a cross section of an optical fiber end surface polishing machine according to the present invention. A ferrule 1 is provided with a minute hole extending through it along the axis of the ferrule. An optical fiber is held in the hole. A ferrule-holding jig 2 holds the ferrule 1 in such a way that it is tilted inwardly by a normalized angle Θ. Indicated by 11 is a base. A polishing platen 3 is mounted over the base 11. A resilient body 4 is stuck to the polishing platen 3. A resilient sheet 5 is stuck to the resilient body 4. The polishing platen 3 is caused to make a rotary motion about an axis 30 and a circular motion along a circular path. The polishing platen 3 assumes an elliptical form which makes a minute angle of Δ to a plane vertical to the axis of rotation (the axis of the rotary motion or the axis of the circular motion). The height of the elliptical form increases from the outer periphery toward the center. The ferrule 1 is pressed against the polishing sheet 5 by the ferrule-holding jig 2 and also by a pressure-applying shaft 40, the jig 2 forming a ferrule-holding portion. A support rod 41 prevents the ferrule-holding jig 2 from being rotated together with the polishing platen 3.

In the above-described polishing machine, the ferrule is held to the ferrule-holding jig 2 at the angle Θ to the axis of rotation of the polishing platen 3. The polishing platen 3 is tilted in such a way that the angle made between the axis of the ferrule and the normal to the polishing platen 3 increases by Δ from Θ. Therefore, by optimizing this Δ, the end surface of the ferrule is polished into an oblique convex spherical surface at the normalized oblique polishing angle Θ.

In the polishing machine described above, the ferrule end surface is previously polished at the angle Θ by the use of a surface polishing grinding wheel machine having a flat surface (e.g., a surface normal to the axis of rotation of the polishing platen). Then, the end surface is polished into an oblique convex spherical surface, using a conical polishing platen 3 which is tilted at an angle of Δ to the surface of the surface polishing grinding wheel machine. The vertex lies on the axis of rotation described above. A resilient body and a polishing sheet are placed over the polishing platen 3. In this way, an optical fiber with an oblique convex spherical surface having desired values can be obtained in a short time.

The minute angle Δ of the polishing platen is found by finding such a value of θ which provides Θ'=Θ from the formulas (1) and (2) above and subtracting the normalized angle Θ from the value of θ. Therefore, if the chamfer length L, the chamfer angle α, and the radius of curvature R are known, then the value of Δ is determined. Since the radius of curvature R of the convex spherical surface used in the formulas (1) and (2) are affected by the hardness of the resilient body placed under the polishing cloth and by the polishing conditions such as the force applied to the ferrule, the radius of curvature is found empirically.

In the present example, a correcting angle Δ is imparted to the polishing platen, so that the angle between the ferrule and the polishing platen is θ=Θ+Δ. Of course, the same result can be derived by using a flat polishing platen and tilting the ferrule at an angle of θ=Θ+Δ.

As described thus far, according to the present invention, a ferrule can be polished into an oblique spherical surface at any arbitrary target angle with the above-described simple configuration. Consequently, an oblique convex spherical surface-polished optical fiber end surface having an angle normalized (8 degrees, 10 degrees, 12 degrees, or so on) to achieve low insertion loss and low reflection can be easily obtained.

Furthermore, an optical fiber with an oblique convex spherical surface having desired values can be obtained in a short time by previously performing surface oblique polishing, using a surface polishing platen having a surface perpendicular to the axis of rotation and then polishing the end surface into an oblique convex spherical surface, using a conical polishing platen tilted at an angle of Δ to the above-described surface.

What is claimed is:

1. A method of polishing an optical fiber end surface, comprising the steps of: preparing a ferrule having an axis about which an optical fiber is held; tilting the axis of the ferrule at a given angle Θ to a line normal to a flat surface of a rotary grinding wheel machine; moving an end surface of the ferrule to a position adjacent to the flat surface of the rotary grinding wheel machine; rotating the flat surface of the rotary grinding wheel machine; moving the end surface of the ferrule into contact with the rotating flat surface of the rotary grinding wheel machine to polish the end surface of the ferrule and an end surface of the optical fiber; moving the end surface of the ferrule out of contact with the flat surface of the rotary grinding wheel machine after the end surface of the ferrule and the end surface of the optical fiber have been polished into a flat plane; providing a polishing machine having a platen mounted for rotation about an axis, a resilient body disposed on a surface of the platen, and a polishing member disposed on the resilient body; tilting the axis of the ferrule at an angle θ to the axis of rotation of the platen, the angle θ being larger than the given angle Θ by a minute angle Δ; rotating the platen; moving the end surfaces of the ferrule and the optical fiber polished into a flat plane into contact with the polishing member; and moving the end surfaces of the ferrule and the optical fiber out of contact with the polishing member after the end surfaces have been polished into an oblique convex spherical surface so that an oblique angle defined between a plane normal to the axis of the ferrule and a tangent plane at the intersection of the axis of the ferrule and the convex spherical surface is equal to the given angle Θ.

2. A method of polishing an optical fiber end surface as claimed in claim 1; wherein the preparing step includes forming a chamfered portion at a foremost end of the ferrule having the end surface.

3. A method of polishing an end surface of an optical fiber, comprising the steps of:

providing an optical fiber assembly comprising a ferrule having a central axis and an insertion hole extending through the ferrule along the central axis, and an optical fiber fixedly supported in the insertion hole and having an end surface extending to a foremost end of the ferrule;

providing a first polishing machine having a flat polishing member mounted for rotation about an axis;

moving the foremost end of the ferrule to a position adjacent to the flat polishing member;

tilting the central axis of the ferrule at a preselected angle Θ to the axis of rotation of the flat polishing member;

rotating the flat polishing member;

moving the foremost end of the ferrule into contact with the flat polishing member to polish the foremost end of the ferrule and the end surface of the optical fiber;

moving the foremost end of the ferrule out of contact with the flat polishing member after the foremost end of the ferrule and the end surface of the optical fiber have been polished into a flat plane;

providing a second polishing machine having a platen mounted for rotation about an axis, a support surface normal to the axis of rotation of the platen for supporting the platen, a resilient body integrally connected to a surface of the platen, and a polishing member integrally connected to a surface of the resilient body, the surface of the platen being tilted at a minute angle Δ to the support surface;

moving the foremost end of the ferrule and the end surface of the optical fiber polished into a flat plane to a position adjacent to the polishing member of the second polishing machine;

tilting the central axis of the ferrule at the preselected angle Θ to the axis of rotation of the platen and at an angle $\theta=\Theta+\Delta$ to a line normal to the surface of the platen;

rotating the platen;

moving the foremost end of the ferrule and the end surface of the optical fiber polished into a flat plane into contact with the polishing member of the second polishing machine to polish the foremost end of the ferrule and the end surface of the optical fiber; and moving the foremost end of the ferrule and the end surface of the optical fiber out of contact with the polishing member of the second polishing machine after the foremost end of the ferrule and the end surface of the optical fiber have been polished in to an oblique convex spherical surface so that an oblique angle defined between a plane normalo to the central axis of the ferrule and a tangent plane at the intersection of the central axis of the ferrule and the convex spherical surface is equal to the preselected angle Θ.

4. A method of polishing an end surface of an optical fiber as claimed in claim 3; wherein the ferrule has a chamfered portion at the foremost end.

5. A method of polishing an end surface of an optical fiber, comprising the steps of:

providing an optical fiber assembly comprising a ferrule having a central axis and an insertion hole extending through the ferrule along the central axis, and an optical fiber fixedly supported in the insertion hole and having an end surface extending to a foremost end of the ferrule;

providing a first polishing machine having a flat polishing member mounted for rotation about an axis;

moving the foremost end of the ferrule to a position adjacent to the flat polishing member;

tilting the central axis of the ferrule at a preselected angle Θ to the axis of rotation of the flat polishing member;

rotating the flat polishing member;

moving the foremost end of the ferrule into contact with the flat polishing member to polish the foremost end of the ferrule and the end surface of the optical fiber;

moving the foremost end of the ferrule out of contact with the flat polishing member after the foremost end of the ferrule and the end of the optical fiber have been polished into a flat plane;

providing a second polishing machine having a platen mounted for rotation about an axis, a support surface normal to the axis of rotation of the platen for supporting the platen, a resilient body integrally connected to a surface of the platen, and a polishing member integrally connected to a surface of the resilient body;

moving the foremost end of the ferrule and the end surface of the optical fiber polished into a flat plane to a position adjacent to the polishing member of the second polishing machine;

tilting the central axis of the ferrule at an angle greater than Θ to a line normal to the surface of the platen;

rotating the platen;

moving the foremost end of the ferrule and the end surface of the optical fiber polished into a flat plane into contact with the polishing member of the second polishing machine to polish the foremost end of the ferrule and the end surface of the optical fiber; and moving the foremost end of the ferrule and the end surface of the optical fiber out of contact with the polishing member of the second polishing machine after the foremost end of the ferrule and the end surface of the optical fiber have been polished into an oblique convex spherical surface so that an oblique angle defined between a plane normal to the central axis of the ferrule and a tangent plane at the intersection of the central axis of the ferrule and the convex spherical surface is equal to the preselected angle Θ.

6. A method of polishing an end surface of an optical fiber as claimed in claim 5; wherein the ferrule has a chamfered portion at the foremost end thereof.

* * * * *